US005621167A

United States Patent [19]

Fang-Cheng

[11] Patent Number: 5,621,167

[45] Date of Patent: Apr. 15, 1997

[54] EXHAUST GAS RECIRCULATION SYSTEM DIAGNOSTIC

[75] Inventor: Jessa F. Fang-Cheng, Brighton, Mich.

[73] Assignee: General Motors Corporation, Detroit, Mich.

[21] Appl. No.: 496,940

[22] Filed: Jun. 30, 1995

[51] Int. Cl.[6] ..... G01M 15/00

[52] U.S. Cl. ..... 73/118.1; 123/571

[58] Field of Search ..... 73/117.2, 117.3, 73/118.1, 118.2; 123/571, 568, 676, 677, 683, 684

[56] References Cited

U.S. PATENT DOCUMENTS

| | | | |
|---|---|---|---|
| 4,173,205 | 11/1979 | Toelle . | |
| 4,373,497 | 2/1983 | Hamren . | |
| 4,671,107 | 6/1987 | Chiesa et al. . | |
| 4,719,893 | 1/1988 | Buslepp et al. . | |
| 5,014,203 | 5/1991 | Miyazaki et al. . | |
| 5,207,093 | 5/1993 | Maeda | 73/118.1 |
| 5,257,610 | 11/1993 | Ohuchi . | |
| 5,309,887 | 5/1994 | Kondo et al. | 123/571 |
| 5,341,300 | 8/1994 | Fujimoto . | |
| 5,474,051 | 12/1995 | Matsumoto et al. | 123/571 |
| 5,488,938 | 2/1996 | Ohuchi | 73/117.3 |
| 5,503,129 | 4/1996 | Robichaux et al. | 123/571 |
| 5,513,616 | 5/1996 | Matsumoto et al. | 123/571 |

OTHER PUBLICATIONS

Document Number 08/265,092 Date filed 24 Jun. 94 Name Wade.

*Primary Examiner*—Richard Chilcot
*Assistant Examiner*—Eric S. McCall
*Attorney, Agent, or Firm*—Michael J. Bridges

[57] ABSTRACT

Internal combustion engine exhaust gas recirculation (EGR) system diagnostics provides for intrusive analysis of the performance of the EGR system in two phases which are alternately activated while the engine is in a stable, hot idle operating region. A first phase approximates EGR system performance through an abbreviated opening of an EGR valve to permit a limited amount of EGR pass to an engine intake air passage so that limited measurement of the effect of the EGR on intake air passage pressure may be made with minimum disruption of engine performance and emissions control performance. If the first phase indicates a potential EGR system problem, the second phase is activated and the first phase is deactivated. The second phase confirms or refutes the results of the phase one analysis through a prolonged opening of the EGR valve so that sufficient exhaust gas may pass into the engine intake air passage to permit analysis of the disruption of the intake air passage pressure to reliably diagnose EGR system performance.

12 Claims, 5 Drawing Sheets

EXHAUST GAS RECIRCULATION SYSTEM DIAGNOSTIC

FIELD OF THE INVENTION

This invention relates to automotive vehicle exhaust gas emission controls and, more particularly, to automotive internal combustion engine exhaust gas recirculation system diagnostics.

BACKGROUND OF THE INVENTION

Recirculation of a portion of internal combustion engine exhaust gas to the engine fresh air intake, generally termed exhaust gas recirculation EGR, reduces engine production and emission of oxides of nitrogen NOx by decreasing the level of oxygen in the engine combustion process, and by reducing the capacity of the engine intake air charge to absorb heat, thereby lowering combustion temperature and frustrating NOx production. The amount of EGR must be closely controlled as too much EGR can significantly reduce engine performance and can actually increase the level of undesirable engine emissions. Accordingly, sophisticated EGR control systems have been developed, for example including precision EGR valves for varying a degree of opening of an exhaust gas conduit positioned between the engine exhaust gas path and the engine fresh air intake path.

The precision EGR valve necessarily must operate in a harsh environment characterized by temperature extremes, vibration, and various contaminants. Despite such harsh operating conditions, the EGR valve is required to maintain a high degree of control precision so that engine emissions may be minimized under many varying engine operating conditions. Likewise, other EGR system components such as the EGR conduit through which the exhaust gas flow and an EGR valve position sensor must remain "healthy" to maintain the integrity of the EGR system. In the event an EGR system component fails to operate as expected, corrective action must be taken as soon as possible, as engine performance and emissions may be negatively affected until the failure is remedied. Any significant EGR system failure that may impact the effectiveness of the system must be diagnosed in a reasonable amount of time and reported so that a remedy may be rapidly applied.

Misdiagnosis of an EGR system fault. condition can result in inconvenient and wasteful fault treatment procedures including unnecessary replacement of EGR system components. Any EGR system or component diagnostic approach must therefore be highly accurate, wherein any failure reported by the approach is associated with a very low potential for misdiagnosis.

EGR diagnostic approaches have been proposed which consume significant engine controller processing time and which add significant engine controller throughput burden. Further, proposed diagnostic approaches are prone to misdiagnosis. Still further, proposed diagnostic approaches only return reliable diagnosis under certain specific operating conditions. If the operating conditions are not present, no diagnostic is available. Still further, proposed intrusive diagnostic approaches may appreciably reduce engine performance or significantly increase engine emissions, or may cause sudden perceptible disturbances that may reflect poorly on engine or vehicle stability.

Accordingly, it would be desirable to provide an EGR system diagnostic that requires minimum processor time and adds minimal additional processor throughput burden yet accurately diagnoses the EGR system under a variety of commonly occurring engine operating conditions with minimum disruption to vehicle operations.

SUMMARY OF THE INVENTION

The present invention provides a significant improvement in EGR system diagnostics. The present diagnostic minimizes processing time and minimizes processor throughput burden through a two tier diagnostic scheme in which a first diagnostic phase which may be quickly executed by the processor is executed at least once for each vehicle operating cycle to quickly diagnose potential fault conditions. If a potential fault condition is diagnosed, a second phase is activated and the first phase deactivated. The second phase includes a more detailed analysis of the health of the EGR system, requiring more processing time and adding more throughput burden than the first phase, but reliably and accurately diagnosing the fault condition to avoid misdiagnosis. The second phase is executed once when activated to confirm or refute the potential fault condition. The first phase is characterized by minimum disruption of ongoing vehicle control processes, as it is limited to only those diagnostic operations necessary to generate a suspicion of a fault condition. Once a suspicion is generated, phase two provides for a single test cycle of slightly more intrusive diagnostic activity, such as just enough activity to confirm or refute the suspicion. As such, engine performance and emissions are preserved and are only affected when a potential fault condition is suspected.

In yet a further aspect of this invention, neither diagnostic phase is executed until the engine is operating within a predetermined, frequently occurring vehicle operating region which provides for stable engine operating conditions in-which engine intake-manifold absolute air pressure changes may be closely correlated to changes in delivered EGR volume, such as stable hot idle operating conditions. Such operating conditions are preselected to ensure that up-to-date diagnostic information is available and that the diagnostic information is an accurate reflection of the performance of the EGR system.

BRIEF DESCRIPTION OF THE DRAWINGS

The invention may be best understood by reference to the preferred embodiment and to the drawings in which.

DESCRIPTION OF THE PREFERRED EMBODIMENTS

Figure 1:
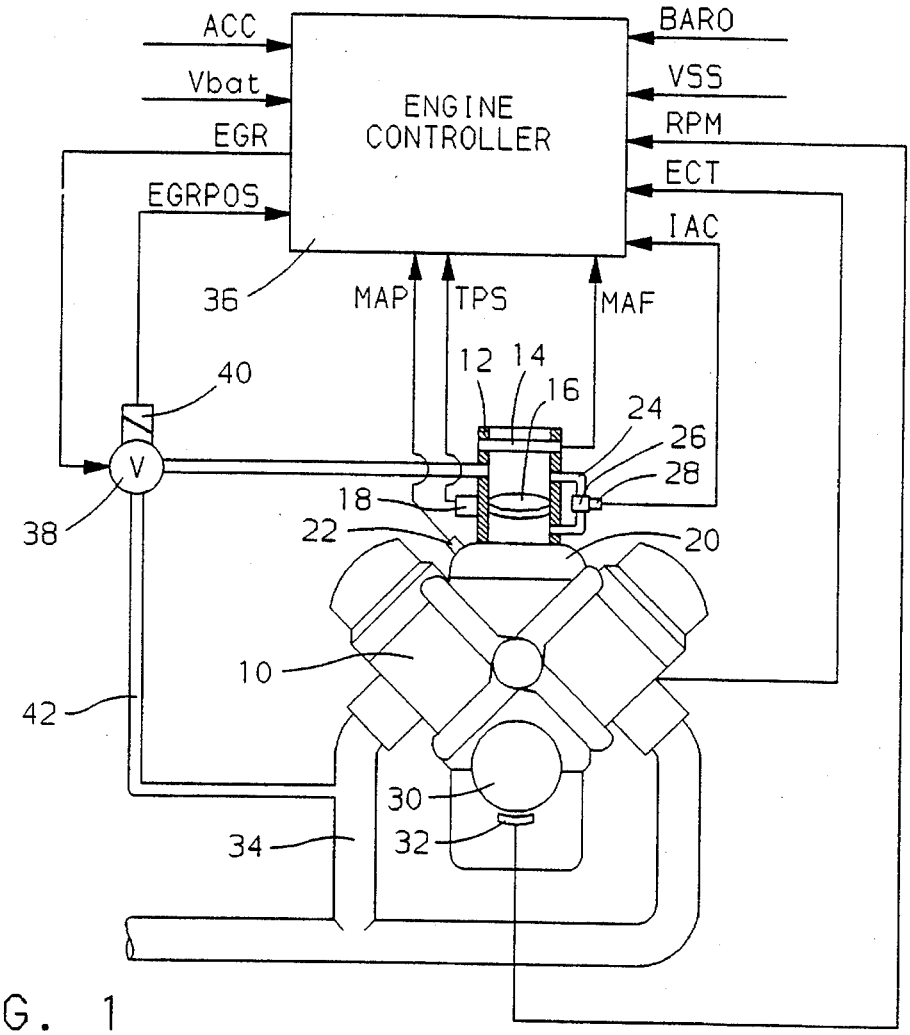
FIG. 1 is a general diagram of engine control hardware provided for use in carrying out the diagnostic of the preferred embodiment.

Referring to FIG. 1, an internal combustion engine 10 receives intake air through intake air bore 12 in which is disposed intake air valve 16, such as a conventional butterfly or rotary valve manually or automatically rotatable to vary the degree of restriction of intake air passing through the bore 12. Rotational position sensor 18, such as a conventional rotary potentiometer, transduces the rotational position of the valve 16 and outputs signal TPS indicative thereof. The intake fresh air mass passing through bore 12 is sensed by mass airflow sensor 14, which may take the form of any conventional automotive mass airflow sensor, such as a thin film or hot wire sensor, outputting a signal MAF indicating the intake fresh air mass. Intake air passing the valve 16 is received in intake manifold 20 for distribution to engine cylinders (not shown). Absolute air pressure transducer 22 of any conventional automotive design is disposed in the intake manifold 20 for transducing absolute air pressurge in the manifold and for outputting signal MAP indicative thereof. Intake air bypass conduit 24 provides for passage of intake air past valve 16. Bypass valve 26, such as a conventional linear solenoid valve, is disposed in the conduit 24 and is positioned to vary restriction in the conduit 24 to flow of intake air to the engine intake manifold 20, for example to provide engine operation while intake air valve 16 is substantially closed. The position of bypass valve 26 is transduced by conventional position sensor 28, such as a potentiometric position sensor, and is output as signal IAC.

The intake air is combined with an injected fuel quantity and delivered for combustion to the engine cylinders (not shown), wherein the combustion produces exhaust gasses which are guided out of the cylinders through exhaust gas conduit 34, for example to a catalytic treatment device, for emissions reduction operations. A portion of the exhaust gas is guided through EGR conduit 42 for combination with fresh air passing through bore 12 in an exhaust gas recirculation EGR process. The low intake manifold pressure relative to the pressure in exhaust gas conduit 34 supports the EGR process. To maintain a proper EGR flow, EGR valve 38, such as a conventional linear solenoid valve, is positioned in the EGR conduit 42 to restrict the exhaust gas flow therethrough, for example taking into account the relative pressure across the valve, so that the engine intake air charge is sufficiently diluted by the EGR to reduce NOx emissions, as is generally understood in the art, but not so diluted to significantly reduce engine performance or to increase other engine emission elements.

The position of the EGR valve 38 is transduced by conventional linear potentiometer or other conventional position sensor 40, such as may be suited for use in detecting the absolute valve position or displacement, and for outputting signal EGRPOS indicative thereof. The combustion of the air/fuel mixture in the engine cylinders drives engine output shaft to rotate, and the rate of rotation is sensed by conventional Hall effect or variable reluctance sensor 32 which outputs signal RPM having a frequency proportional to engine speed and containing information that may be translated into engine relative engine angular position. A conventional microcontroller 36, such as a generally available Motorola eight-bit or sixteen bit microcontroller is provided including such standard elements as a central processing unit including arithmetic logic circuitry, a read only memory ROM, a random access memory RAM, and input-output circuitry.

The controller 36 receives the described input signals and further receives input signals generally understood to be available in conventional commercial engine control applications, including signal ACC indicating in a binary manner whether the air conditioner clutch (not shown) is engaged or disengaged, signal Vbat indicating the battery voltage level, signal BARO indicating barometric pressure external to the vehicle, signal VSS indicating the speed of motion of the vehicle, and signal ECT indicating engine coolant temperature. It should be noted that various generally-known sensing approaches may be used to generate the input signals applied to the controller 36. For example, the signal BARO may come from a dedicated barometric pressure sensor, or may come from air pressure transducer 22 under engine operating conditions in which there is substantially no pressure drop across the intake air valve 16. As a further example, signal VSS may be generated by a conventional vehicle wheel speed sensor (not shown) or may be generated by the controller 36, for example using sensed engine speed RPM and information on current transmission gear ratio.

The controller 36, through execution of a series of control, diagnostic and maintenance operations, generates control and diagnostic signals and outputs the signals to various conventional actuators and indicators to provide for vehicle control and diagnostic operations including, in this embodiment, EGR system diagnostic operations for diagnosing the EGR system performance, wherein the EGR system may be defined as including the EGR valve 38, the EGR conduit 42, and the EGR valve position sensor 40.

Figure 2A:
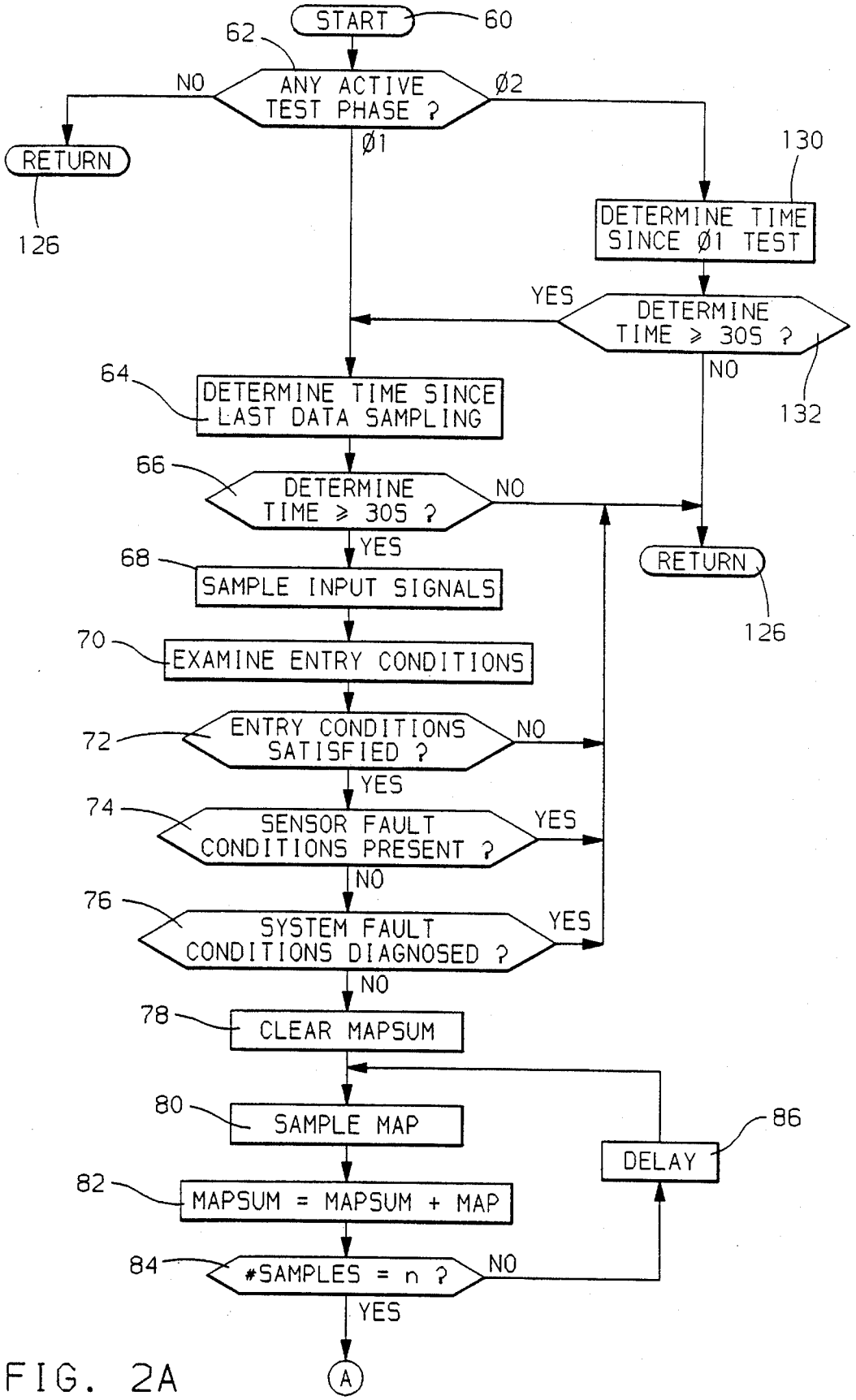
FIGS. 2*a*–2*c* are computer flow diagrams for illustrating a series of controller operations for carrying out the preferred embodiment of this invention.
Figure 2B:
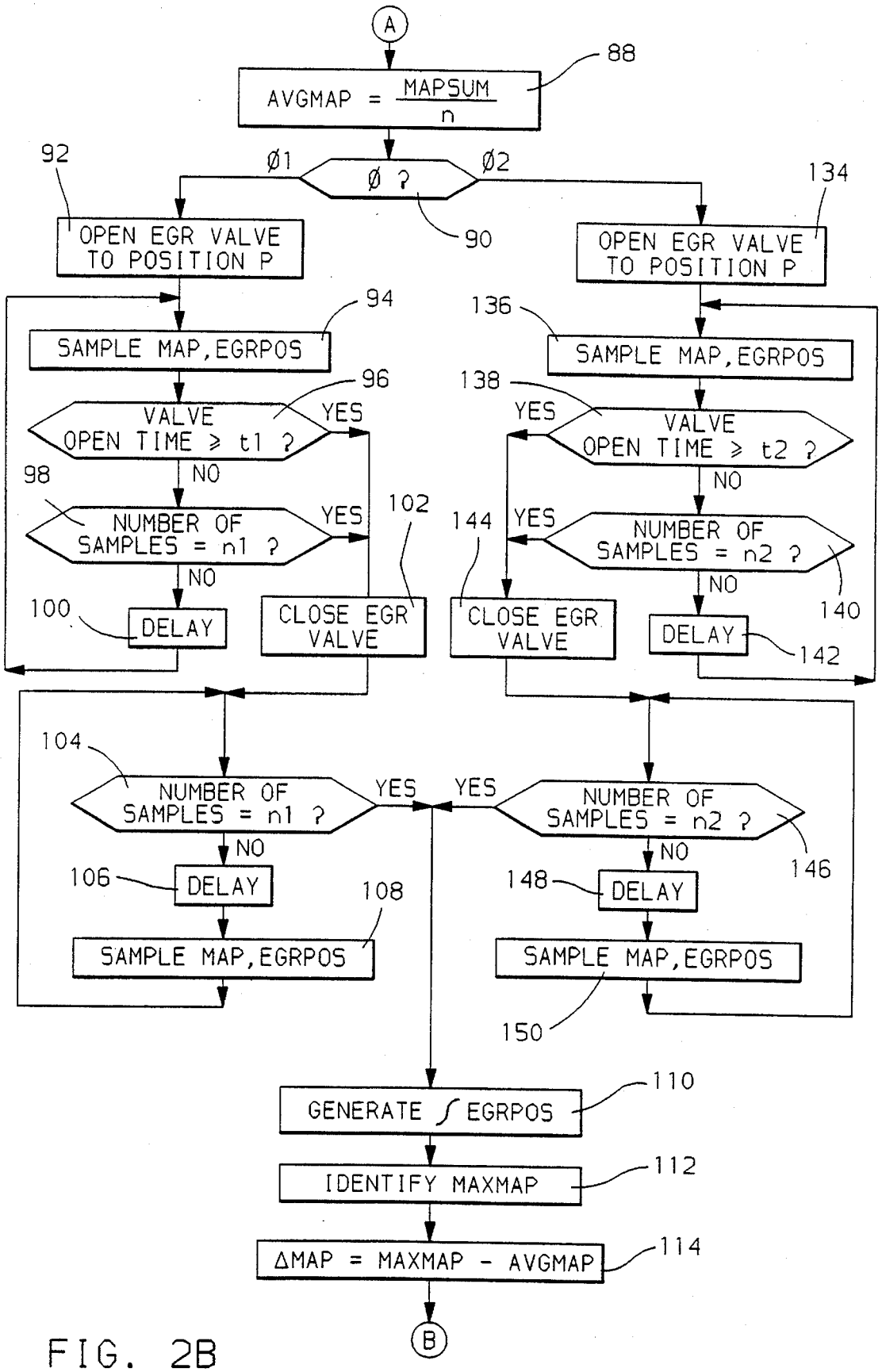
Figure 2C:
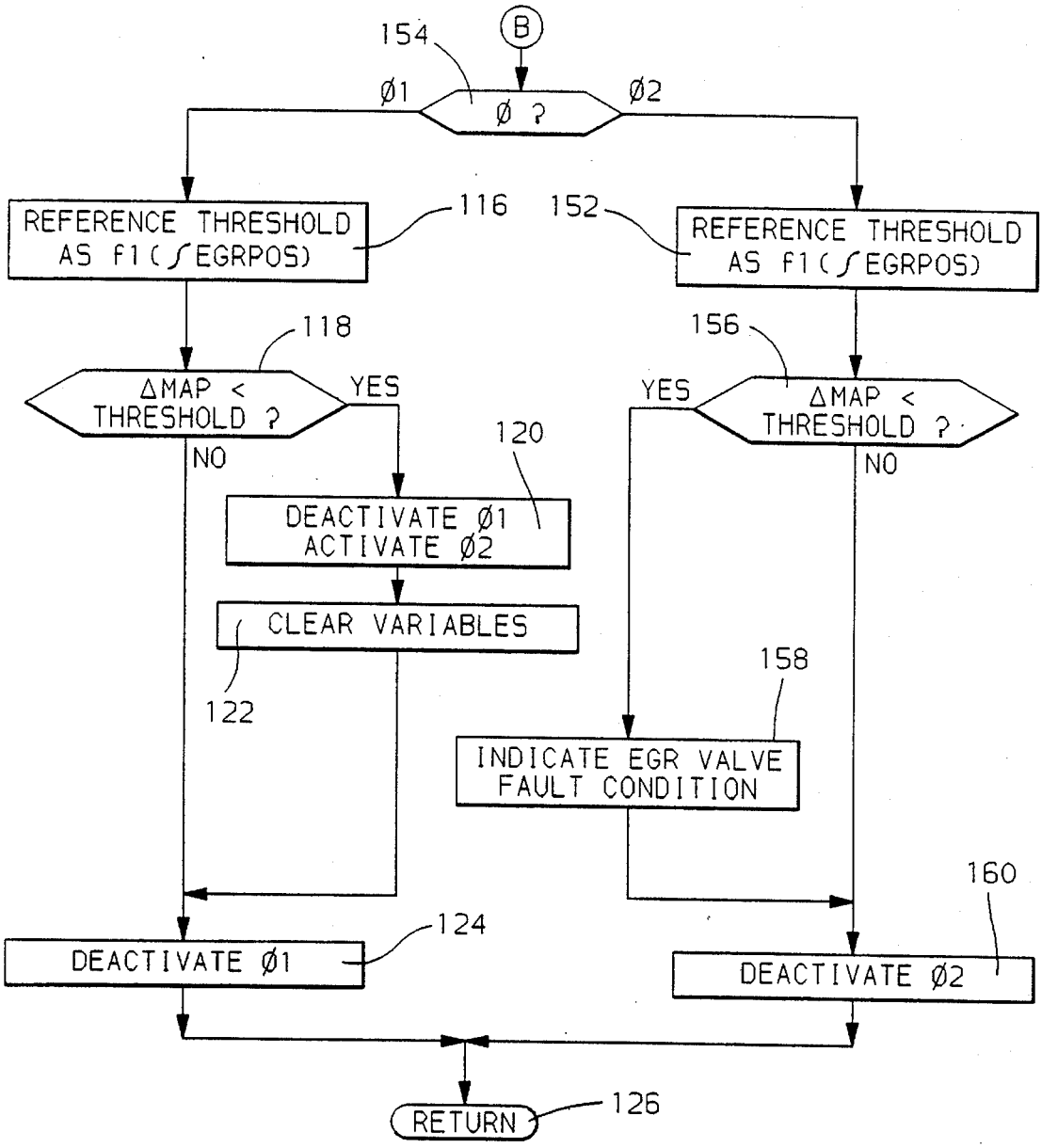

Such EGR diagnostic operations are generally described in a step by step manner by the flow of operations of FIGS. 2*a*–2*c*. Such operations may be periodically executed while the engine 10 is running under authority of the controller 36. In this embodiment, the routine of FIGS. 2*a*–2*c* is executed once for each vehicle operating cycle to carry out the two tier (two phase) EGR system diagnostic in accord with the present invention. In other words, between each engine power-on operation and the following engine power-off operation, the diagnostic of the present embodiment as illustrated in FIGS. 2*a*–2*c* will be executed once, to ensure an up-to-date diagnosis of the EGR system without adding significantly to the controller throughput burden. Generally, this diagnostic provides for a first diagnostic phase that is quickly executed with minimum disruption to other vehicle control and diagnostics operations and with minimum additional controller 36 throughput burden and processing time. The first phase is simply designed to quickly estimate EGR system performance and to activate more detailed diagnostic operations, called phase two operations, when the performance is suspect. When phase two is activated, phase one operations are deactivated. Phase two operations are more burdensome to the controller 36, and have a greater potential to disrupt ongoing control or diagnostic operations. However, phase two operations can, with a high degree of confidence, affirm or refute the suspicions raised by the phase one operations. Once the phase two operations have confirmed that indeed a fault condition is present in the EGR system, or have cleared the EGR system as substantially fault free, phase two operations are deactivated. No further diagnostic analysis of the EGR system is then provided until the next vehicle operating cycle, so that the controller 36 may be freed up to carry out its other control, diagnostic and maintenance tasks with minimum disruption.

Returning to the routine of FIGS. 2*a*–2*c*, the operations of such routine are initiated about every 100 milliseconds while the controller 36 is operating until a complete diagnostic of the EGR system has been provided. Initiation of the routine may be provided through a timer interrupt configured to direct controller attention to, among other conventional control or diagnostic routines, the operations of FIGS. 2*a*–2*c*, beginning at a step 60 and moving next to a step 62 to determine if any phase of the diagnostic test is active. The current diagnostic test comprises two phases. The first phase may be characterized as a brief diagnostic phase to generally estimate EGR system performance, as described. The first phase is active automatically when power is first applied to the controller following a period in which the engine 10 is turned off. If the first phase indicates a potential performance problem with the EGR system, the second phase is activated and the first phase is deactivated, wherein the second phase may be described as a more throughput-intensive analysis of EGR system performance to precisely determine whether a performance problem must be indicated and acted on. Once the second phase has completed analysis of the EGR system performance, it is disabled to prevent further throughput burden until the engine is turned off and then turned back on, at which time phase one is automatically activated to pass through another test, etc.

Returning to step 62, if neither phase 1 nor phase 2 are currently active, the diagnostic operations proceed to a step 126 to return to any operations that were ongoing at the time the routine of FIGS. 2*a*–2*c* was initiated. However, if phase one is determined to be active at the step 62, the time since the last diagnostic data sampling is determined at a next step 64. The time of the last diagnostic data sampling corresponds to the most recent time that engine intake manifold pressure was sampled during a prior iteration of the routines of FIGS. 2*a*–2*c*. If the determined time exceeds 30 seconds at a next step 66, then prior test conditions may affect the veracity of the current diagnostic operations, and the diagnostic of the current iteration of FIG. 2*a* is aborted by proceeding to the described step 126. Generally, a plurality of test conditions must be sustained over a test period to ensure the most accurate test results in the current embodiment. If any test conditions are not sustained, the test is aborted and a period of time is required for the effects of the test to substantially diminish so that future testing is not affected thereby. In this embodiment, the amount of delay between test attempts is calibrated as about 30 seconds, as described at the step 66.

However, if the time between samples exceeds 30 seconds at the step 66, the testing may continue by proceeding to sample a plurality of input signals at a next step 68 to estimate the current engine operating condition. More specifically, current values of ECT, VSS, BARO, IAC, TPS, MAF, RPM, ACC, and Vbat are sampled at the step 68, wherein such input signals are as described in FIG. 1. After sampling the input signals, a plurality of test conditions are examined at a next step 70, to determine generally whether the engine and vehicle are operating in a stable hot idle condition for a period of time. Such a condition occurs commonly during typical automotive vehicle operation and as such is well-suited to the current diagnostic so that up to date diagnostic information is available for more complete fault coverage in accord with a described aspect of this invention. Such a condition is characterized by a close correlation between intake manifold pressure and EGR valve position. If such conditions are present during the analysis of the step 70, the diagnostic operations of the present embodiment may be carried out. Such entry conditions are as follows: include ECT above a calibrated threshold temperature of about 86 degrees Celsius, zero VSS, BARO above a calibrated threshold pressure of about 85 kPa, very little recent movement of the bypass valve 26 of FIG. 1, such as less than a one percent change in IAC valve position over a time period of about one hundred milliseconds, zero TPS, change in MAF of less than 0.1 grams over a time period of about 100 milliseconds, engine speed between 700 r.p.m. and 800 r.p.m., ACC not currently in transition, and Vbat above about twelve volts. If any of these conditions are not met as determined at the step 70, the engine is assumed to not be in the stable hot idle operating region, and the test is aborted at a next step 72, by proceeding to the described step 126. If all conditions are satisfied, the diagnostic test is continued by proceeding to check for any current sensor fault conditions at a next step 74. For example, if the EGR valve position sensor 40 (FIG. 1) or the MAP sensor 30 (FIG. 1), both of which provide essential information for the current diagnostic, or the sensors providing the signals sampled at the described step 68 are faulty, then the veracity of the current diagnostic operation may be reduced to an unacceptably low level.

If any fault condition, such as may be diagnosed through any conventional diagnostic approach generally understood in the art, is determined to be present at the step 74, the current diagnostic test is aborted by proceeding to the described step 126. If no fault conditions are present, a next step 76 is executed to determine if any system fault conditions are present, such as in the engine coolant circulation system which may be any conventional coolant circulation system known in the automotive art, or in the idle air control system of FIG. 1. If fault conditions are present in either system, the integrity. of the current diagnostic may be reduced to an unacceptably low level, and the current diagnostic is aborted by proceeding to the described step 126.

If no system fault conditions are determined to be present at the step 76, a data storage position in random access memory, labeled MAPSUM is cleared at a next step 78, and-manifold absolute pressure from signal MAP of FIG. 1 is sampled at a next step 80. The MAP sample is added to MAPSUM at a next step 82, and the number of MAP samples is next compared to a predetermined value n at a next step 84. In this embodiment, n is calibrated as 3. If the number of samples is not greater than 3 at the step 84, then more MAP samples are required and a delay of about 12.5 milliseconds is provided at a next step 86, before proceeding back to repeat the steps 80 and 82. The delay ensures that MAP samples used to form MAPSUM are spaced by at least 12.5 milliseconds to provide for a gathering of MAP information over a longer time period, so that the MAPSUM includes a general MAP signal characteristic, for example so as to not be polluted by any single engine event. The steps 80 and 82 are repeated along with the delay of step 86 until n samples of MAP have been applied to form MAPSUM. When the number of samples equals n at the step 84, a simple average of the MAP samples is formed at a next step 88, by dividing MAPSUM by n.

Figure 4A:
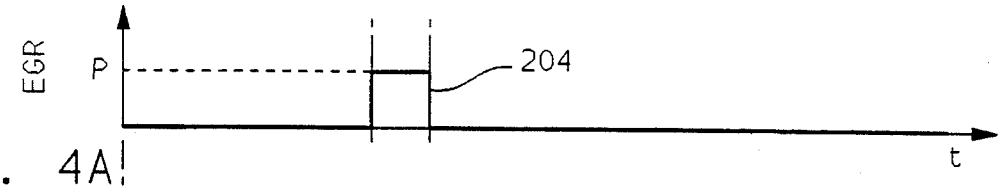
FIGS. 4*a*–4*d* are signal diagrams illustrating typical diagnostic signals relied on by the diagnostic operations of the preferred embodiment.

The current active test phase is next determined at a step 90. If in phase one of the current diagnostic test, the EGR valve 38 (FIG. 1) is commanded to open to a test position P at a next step 92. The test position P is a predetermined position that provides for a significant change in engine intake manifold absolute pressure MAP that is to be used in diagnosing the EGR system including the EGR valve 38, the valve position sensor 40, and the conduit 42. In this embodiment, due to the short duration of the diagnostic test, position P is the maximum valve open position corresponding to a minimum restriction of the conduit 42 for maximum exhaust gas flow therethrough. The commanding of the valve to open to the position P may be provided by setting command signal EGR to a maximum calibrated drive current or drive voltage, for example as is generally understood in the art. Signal 204 of FIG. 4*a* illustrates the step change in command signal EGR applied to the EGR valve 38 (FIG. 1) at the step 92.

Figure 4B:
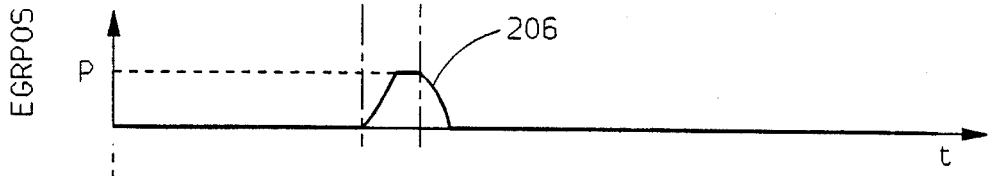

The actual, sensed EGR valve position EGRPOS and the current manifold absolute pressure MAP are next sampled at a step 94, to determine not only how the EGR valve 38 is moving toward the commanded position, but how that change in position is affecting manifold pressure, in accord with the diagnostic of the present invention. Signal 206 of FIG. 4*b* illustrates a typical change in EGR valve position over time, such as sampled via sensor output signal EGRPOS of FIG. 1, in response to the corresponding change in command signal EGR of signal 204 of FIG. 4*a*.

The amount of time that the EGR valve 38 has been allowed to open is next compared to a constant t1 at a step 96. To minimize the intrusiveness of the current diagnostic on other control processes, the amount of Valve opening time is limited to the minimum amount of time necessary for the described phase one diagnostic to estimate generally the EGR system performance. In this embodiment, this time is t1 of about 40 milliseconds. If the valve opening time exceeds time t1 at the step 96, the EGR valve 38 is commanded to move to its closed position corresponding to no exhaust gas flow through the Conduit 42 (FIG. 1), at a next step 102, such as illustrated by the falling edge of signal 204 of FIG. 4*a*. The number of samples taken during the current test is next compared to a calibration constant n1 at a step 104.

Figure 4C:
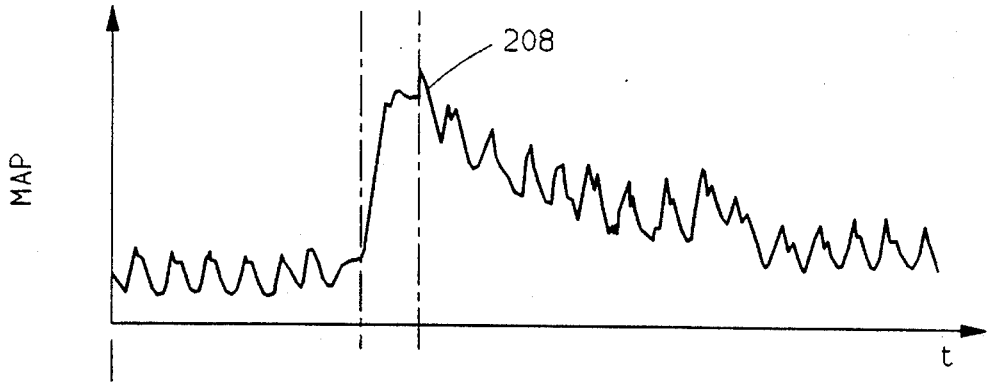
Figure 4D:
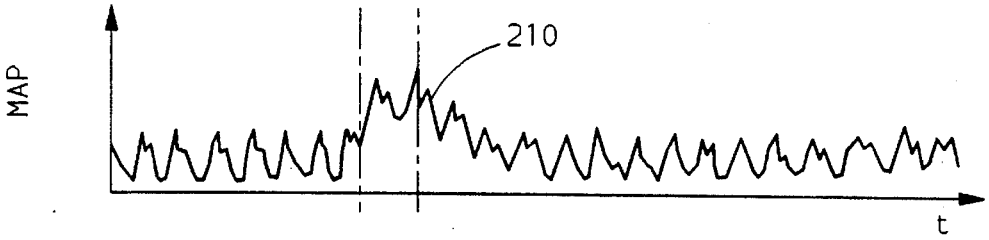

Generally, the present diagnostic requires periodic sampling of the EGR valve position and of the manifold pressure to measure the maximum pressure disruption in the engine intake manifold as a result of a change in EGR valve 38 position. To ensure that the maximum disruption is detected, sampling during and after the opening of the EGR valve 38 is required, for example to account for transportation delays in the system. As illustrated in the typical MAP signal 208 of FIG. 4*c* in which MAP is responding to commanded change in position of the EGR valve as illustrated in the corresponding signal 204 of FIG. 4*a* in accord with this diagnostic, the MAP signal increases significantly with change in commanded EGR valve position, as the actual EGR valve position EGRPOS of FIG. 4*b* moves to position P in a "healthy" EGR system. Signal 210 of FIG. 4*d*. illustrates the same MAP response curve for an EGR system experiencing a fault condition, such as an EGR valve failure, a EGR valve position sensor failure, or an EGR conduit failure, such as due to blockage therein. The MAP change in signal 210 resulting from the command change in EGR valve position of FIG. 4*d* is of much lower amplitude than that of signal 208 of FIG. 4*c*, indicating in an essential aspect of this invention, that controlled variation in EGR valve position does not impact MAP in a manner characteristic of calibrated "healthy" EGR systems. The significant change in amplitude is diagnosed by comparing the peak MAP amplitude during and shortly after the EGR valve 38 is repositioned to an average of MAP value with no such EGR valve 38 repositioning.

AS illustrated in both response signals 208 and 210, due to the short EGR valve 38 opening time of 40 milliseconds of the present phase one, the maximum change in MAP resulting from the EGR valve 38 opening may not occur until after the EGR valve 38 is commanded closed, such as after the falling edge of signal 204 of FIG. 4*a*. To measure this maximum change, sampling may have to continue after the time of closing of the EGR valve 38. Returning to step 104, if the-number of MAP and EGRPOS samples equals n1, calibrated as six in this embodiment, then sampling for phase one is complete, and the routine moves to analyze the sampled information beginning at a step 110. If the number of samples taken does not equal n1 at the step 104, a delay of about 12.5 milliseconds is processed at a next step 106, and then another sample of MAP and EGRPOS is taken at a next step 108. Steps 104, 106 and 108 are continuously repeated in this manner until the number of samples equals n1, as determined at the step 104, at which time the step 110 is executed.

Returning to step 96, if the valve opening time is not greater than or equal to t1, the number of samples is compared to n1 at a next step 98. If the number of samples does not equal n1, more are required, and are taken at the step described step 94 following a 12.5 millisecond delay at a next step 100. If the number of samples do equal n1, the EGR valve 38 is closed at the described step 104, to minimize the intrusiveness of the test, as there is no further incentive to intrusively leave the EGR valve 38 open following the completion of sampling.

Continuing with the phase one test operations, the sampled MAP and EGRPOS information is processed and analyzed at steps 110–124. First, the EGRPOS samples are integrated over the period of the test at a step 110, to form value ∫EGRPOS as an indirect measurement of total EGR flow during the test. Next, the maximum sampled MAP value during sampling operations of the phase one diagnostic is identified and labeled as MAXMAP at a step 112. The difference between MAXMAP and the determined AVGMAP from step 88 is next calculated at a step 114 and is labeled ΔMAP.

Figure 3:
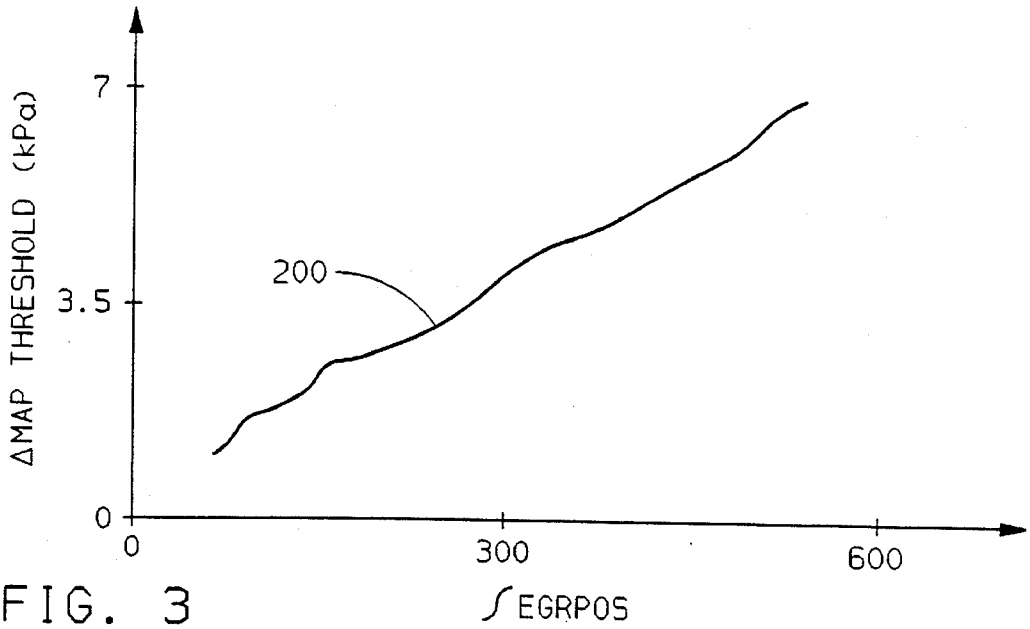
FIG. 3 is a diagram illustrating a calibrated relationship between a reference parameter and a lookup parameter in accord with the preferred embodiment.

If the test is in phase one as determined at a next step 154, a ΔMAP threshold value is referenced at a next step 116 as a function f1 of ∫EGRPOS. Curve 200 of FIG. 3 illustrates the calibrated relationship f1 between ∫EGRPOS and the ΔMAP threshold value for the hardware of FIG. 1. The function f1 is determined through a conventional calibration process for each of a range of ∫EGRPOS values likely to be encountered in the current diagnostic analysis as the minimum MAP change that is normally caused by a "healthy" EGR system in which the EGR valve 38 (FIG. 1) moves to the position P for the period of time t1. A "healthy" EGR system is generally characterized in this embodiment as an EGR system capable of meeting generally understood or publicly promulgated performance standards, such as pursuant to a significant reduction in NOx levels in the engine emissions of FIG. 1. The function f1 of curve 200 may be stored as a series of paired lookup values in a conventional lookup table format in controller read only memory, wherein a ΔMAP threshold value is returned from the table when the corresponding when the current ∫EGRPOS value is applied as a lookup index or pointer into the table.

After referencing the threshold at the step 116, the determined ΔMAP value is compared to the threshold at a next step 118. If ΔMAP is less than the threshold, then the change in commanded EGR did not have the expected impact on engine intake manifold absolute pressure, indicating a potential EGR system fault condition. To avoid misdiagnosis of the condition, further testing of a more accurate albeit intrusive nature will then be required under phase two of the present diagnostic, to confirm or refute the estimated conditions made under phase one analysis. Accordingly, if MAP is less than the threshold at the step 118, the phase two analysis is activated and the phase one analysis is deactivated at a next step 120, and all test variables are cleared at a next step 122 to prepare for a completely new analysis of the EGR system under phase two.

Returning to step 118, if ΔMAP is greater than or equal to the threshold, the phase one diagnostic did not diagnose any potential fault condition in the EGR system, as the intake manifold pressure under the test conditions was adequately responsive to the change in EGR to indicate a "healthy" EGR system, with a minimum of intrusiveness and added burden to the controller 36 of FIG. 1, as. described. Accordingly, the intrusive testing of phase two is not required, and the phase one diagnostic analysis is deactivated at a next step 124, until the next time the engine 10 is turned on, as described. Additionally, a "pass" flag may be set at the step 124 to indicate that the diagnostic test of this embodiment has been passed. After deactivating phase one analysis and, if necessary, activating phase two, the described Step 126 is executed to return to any prior temporarily suspended controller operations.

Phase two diagnostic analysis provides for a more detailed albeit more intrusive investigation of the responsiveness of engine intake manifold absolute pressure to EGR flow changes to confirm or refute the potential fault condition diagnosed through the quick analysis of phase one. Returning to step 62 of FIG. 2*a*, if phase two is active, such as provided at the described step 120 of FIG. 2*c*, then the time since the phase one test operations is determined at a next step 130. If the time exceeds a calibrated time, such as 30 seconds, as determined at a next step 132, then sufficient time has elapsed since the described phase one operations that the effects of the intrusive testing thereof have settled so as to not significantly impact the phase two analysis, and the testing is allowed to continue by proceeding to a next step 64. However, if the elapsed time since phase one does not exceed the calibrated time as determined at the step 132, the phase two analysis is not provided for by proceeding to the described step 126.

If the phase two operations are allowed to continue from the step 132, the described operations of step 66–88 are executed in the manner described for phase one, wherein a plurality of entry conditions must be met to continue the test and wherein an average MAP value AVGMAP is determined at the step 88. After determining the AVGMAP value, the step 90 is executed to determine the active test phase. If phase two is active, a next step 134 is executed at which the EGR valve 38 (FIG. 1) is commanded to open to a predetermined calibration position, such as the described position P of the step 92 of the phase one analysis. The position is selected during a conventional calibration process as a sufficient position to precisely establish a relationship between the recirculated engine exhaust gas and the corresponding change in intake manifold absolute pressure MAP. After commanding the EGR valve 38 to open to the position P, samples of MAP and EGRPOS are taken at a next step 136. The valve opening time is next compared to a predetermined time t2 at a step 138. If the opening time exceeds or is equal to t2, which is set to about 60 milliseconds in this embodiment, to provide for more intrusive albeit more precise diagnostics of the EGR system, then it is assumed that the EGR system has had ample time to measurably impact intake manifold pressure so that a reliable diagnosis of the EGR system may be made. The time t2 is calibrated to allow for reliable diagnostic analysis of the EGR system despite having a potential to temporarily reduce powertrain performance or increase emissions. Nonetheless, by avoiding the phase two analysis until the substantially unintrusive phase one analysis indicates a potential fault condition, the intrusiveness of the overall diagnostic of this embodiment is minimized. The time t2 of the present embodiment is but one example of the time required for the detailed analysis of phase two. Other test times may be required in accord with the hardware to which they are applied in order to produce. reliable confirmation or refutation of the potential fault condition indicated through the phase one analysis.

Returning to step 138, if the valve opening time exceeds or is equal to t2, the EGR valve 38 is commanded to return to a closed position corresponding to no exhaust flow through conduit 42 at a next step 144. After commanding the EGR valve 38 to close, such as by dropping the voltage or current level of signal EGR (FIG. 4*a*) to zero, the number of EGRPOS and MAP samples taken during the current test is compared to a calibration constant n2 at a next step 146. The constant n2 is established as the number of samples, at the determined sampling rate, needed to ensure that the maximum change in MAP occurring as a result of the intrusive admission of EGR into the engine intake manifold is substantially captured through the sampling process of step 136 or step 150. In this embodiment, n2 is set to nine, to provide for sampling during and after the EGR open time, as the maximum intake pressure deviation may come well after the valve is being commanded closed, as illustrated in FIGS. 4*c* and 4*d*, wherein the important maximum MAP amplitude signal may not occur until after the falling edge of signal 204 of FIG. 4*a*, as described.

If the number of samples equals n2 at the step 146, the described step 110 is executed to begin analysis of the sampled MAP information. If the number of samples does not equal n2 at the step 146, further EGRPOS and MAP samples are taken at a step 150 following a delay period of about 12.5 milliseconds at a step 148. The steps 146–150 are repeated in this manner until nine sets of samples have been taken, at which time the described step 110 is executed.

Returning to step 138, if the valve opening time is less than t2, a next step 140 is executed to determine if the number of samples equals n2. If so, the EGR valve 38 is closed at the described step 144, as no further intrusive EGR valve 38 control activity is required if the sampling of MAP is completed. However, if the number of samples does not equal n2 at step 140, then further samples are taken at the step 136 following a delay of about 12.5 milliseconds imposed at a step 142. The steps 136–142 are repeated in this manner until the valve open time exceeds or is equal to t2, as described, or until the number of samples taken equals n2.

Following collection of the MAP and EGRPOS samples during the phase two test, and after the EGR valve 38 of FIG. 1 is returned to its closed position, the nine EGRPOS samples are integrated to form value ∫EGRPOS at the described step 110, a maximum MAP sample over the nine taken samples is identified and labeled as MAXMAP at the step 112, and a ΔMAP is generated as a difference between MAXMAP and AVGMAP at the step 114. The step 154 then determines the active test phase. If phase two is active, a ΔMAP threshold value us referenced at a next step 152 as a function of the ∫EGRPOS value, such as through conventional lookup table operations applied to the calibrated function f1 illustrated as curve 200 of FIG. 3, wherein ∫EGRPOS is the lookup index or pointer into the lookup table, and the threshold is the reference value. After referencing the threshold, the ΔMAP value is compared to the threshold at a next Step 156. If ΔMAP is less than the threshold, the commanded amount of EGR under the test conditions did not produce the expected increase in manifold pressure as would be characteristic of a "healthy" EGR system under the more accurate test analysis of the phase two diagnostic, and a fault condition is therefore assumed to be present in the EGR system of FIG. 1. Such fault condition is next indicated at a step 158, such as by storing a fault code in controller non-volatile memory or by illuminating a display to notify the vehicle operator of the condition so that appropriate action may be taken to alleviate the fault condition. Next, or if ΔMAP was greater than or equal to the threshold at the step 156, the phase two diagnostic analysis is disabled at a next step 160, to prevent further controller throughput burden or further intrusion on control performance through the present diagnostic. Further diagnostic analysis through the operations of FIGS. 2a–2c will not occur in this embodiment until the next time the engine 10 is turned on, as described. Following deactivation of the diagnostic phase two, execution of any suspended controller operations is resumed through execution of the described step 126.

The preferred embodiment for the purpose of explaining this invention is not to be taken as limiting or restricting this invention since man modifications may be made through the exercise of ordinary skill in the art without departing from the scope of the invention.

The embodiments of the invention in which a property or privilege is claimed are described as follows:

1. A diagnostic method for diagnosing reduced performance of an EGR system for recirculating internal combustion engine exhaust gas from an exhaust gas conduit through a recirculation conduit to an engine intake air passage through positioning of an EGR valve disposed in the recirculation conduit, comprising the steps of:

sampling present values of a predetermined set of engine parameters;

determining when the sampled present values indicate that the engine is operating within a predetermined stable engine operating region;

upon determining that the engine is operating within the predetermined stable engine operating condition, activating a minimally intrusive phase one diagnostic process to drive the EGR valve open and to measure the resulting change in engine intake passage absolute air pressure to approximate the EGR system performance, the phase one diagnostic comprising the steps of:

(a) recirculating engine exhaust gas through the recirculation conduit to the intake air passage for a predetermined phase one test period;

(b) determining change in intake air passage pressure resulting from the recirculated engine exhaust gas;

(c) establishing a maximum determined change in intake air pressure resulting from the recirculated engine exhaust gas;

(d) comparing the established maximum determined change to a change threshold value;

(e) approximating the performance degradation if the established maximum determined change is less than the change threshold value;

if the phase one diagnostic process approximates that the EGR system performance is degraded, deactivating the phase one diagnostic process and activating an intrusive phase two diagnostic process to drive the EGR valve open and to measure the resulting change in engine intake air passage absolute air pressure to confirm or refute the approximation that the performance is degraded; and if the phase two diagnostic process confirms the approximation that the performance is degraded, then indicating a performance degradation in the EGR system.

2. The method of claim 1, wherein the EGR system includes an EGR valve position sensor for transducing the EGR valve position into a position signal, the method further comprising the steps of:

sampling the position signal while the phase one diagnostic process is activated;

estimating actual volume of recirculated engine exhaust gas during the phase one diagnostic; and determining the change threshold value as a predetermined function of the estimated actual volume.

3. The method of claim 1, wherein the phase one diagnostic process further comprises the step of generating a baseline intake air passage pressure value prior to the recirculating step;

and wherein the step of determining change further comprises the steps of (a) sampling intake air passage pressure during and after the predetermined phase one test period, (b) determining the change as the difference between the samples of intake air passage pressure and the generated baseline intake air passage pressure value.

4. A diagnostic method for diagnosing reduced performance of an EGR system for recirculating internal combustion engine exhaust gas from an exhaust gas conduit through a recirculation conduit to an engine intake air passage through positioning of an EGR valve disposed in the recirculation conduit, comprising the steps of:

sampling present values of a predetermined set of engine parameters;

determining when the sampled present values indicate that the engine is operating within a predetermined stable engine operating region;

upon determination that the engine is operating within the predetermined stable engine operating condition, activating a minimally intrusive phase one diagnostic process to drive the EGR valve open and to measure the resulting change in engine intake passage absolute air pressure to approximate the EGR system performance;

if the phase one diagnostic process approximates that the EGR system performance is degraded, deactivating the phase one diagnostic process and activating an intrusive phase two diagnostic process to drive the EGR valve open and to measure the resulting change in engine intake air passage absolute air pressure to confirm or refute the approximation that the performance is degraded, the phase 2 diagnostic process comprising the steps of:

(a) recirculating engine exhaust gas through the recirculation conduit to the intake air passage for a predetermined phase two test period;

(b) measuring the change in intake air pressure resulting from the recirculation of engine exhaust gas;

(c) determining a maximum measured change in intake air pressure;

(d) comparing the determined maximum measured change to a change threshold value; and (e) confirming the approximation that the EGR system is degraded when the determined maximum measured change does not exceed the change threshold value;

if the phase two diagnostic process confirms the approximation that the performance is degraded, then indicating a performance degradation in the EGR system.

5. The method of claim 4, wherein the phase two diagnostic process further comprises the step of generating a baseline intake air passage pressure value prior to the recirculating step;

and wherein the step of measuring the change further comprises the steps of (a) sampling intake air passage pressure during and after the predetermined phase two test period, (b) measuring the change as the difference between the samples of intake air passage pressure and the generated baseline intake air passage pressure value.

6. The method of claim 4, wherein the EGR system includes an EGR valve position sensor for transducing the EGR valve position into a position signal, the method further comprising the steps of:

sampling the position signal while the phase two diagnostic process is activated;

estimating actual volume of recirculated engine exhaust gas during the phase two diagnostic process; and determining the change threshold value as a predetermined function of the estimated actual volume.

7. A multi-phase method for diagnosing the performance of an internal combustion engine exhaust gas recirculation EGR system having an exhaust gas flow path from an engine exhaust gas passage to an engine intake air passage past an EGR valve that may be positioned to vary the restrictiveness of the flow path to the flow of exhaust gas, comprising the steps of:

activating a first test phase to estimate EGR system performance;

when the first test phase is activated, (a) recirculating, for a predetermined short control period, engine exhaust gas through the exhaust gas passage to the engine intake air passage, (b) sensing air pressure change in the engine intake air passage during and following the predetermined-short control period, (c) establishing a maximum sensed air pressure change during and following the predetermined short control period, (d) comparing the established maximum sensed air pressure change to a phase one air pressure change threshold, and (e) deactivating the first test phase and activating a second test phase if the established maximum sensed air pressure change exceeds the phase one air pressure change threshold; and when the second test phase is activated, (a) recirculating, for a predetermined long control period significantly exceeding the duration of the predetermined short control period, engine exhaust gas through the exhaust gas passage to the engine intake air passage, (b) sensing air pressure change in the engine intake air manifold during and following the predetermined long control period, (c) determining a maximum air pressure change from the sensed air pressure change, (d) comparing the determined maximum air pressure change to a phase two threshold value, and (e) indicating an EGR system failure if the determined maximum air pressure change exceeds the phase two threshold value.

8. The method of claim 7, further comprising, while phase one is active, the steps of:

estimating actual recirculated volume of engine exhaust gas; and referencing the phase one threshold value as a predetermined function of the estimated actual recirculated volume of engine exhaust gas.

9. The method of claim 8, wherein the EGR system further comprises an EGR valve position sensor for transducing EGR valve position into a sensor output signal, the method further comprising the step of:

sampling the EGR valve position sensor output signal while phase one is active; and wherein the estimating step estimates the actual recirculated volume of engine exhaust gas as a function of the EGR valve position sensor output signal samples.

10. The method of claim 7, further comprising the steps of:

while the first test phase is active, establishing a baseline air pressure in the engine intake air passage prior to the recirculating step;

wherein the step of sensing air pressure change comprises the steps of (1) sampling air pressure in the intake air passage during and following the predetermined short control period, (2) sensing the air pressure change as the difference between the air pressure samples and the baseline air pressure.

11. The method of claim 10, wherein the step of establishing a baseline air pressure comprises the steps of:

sampling air pressure in the intake air passage during a predetermined sampling period; and establishing the baseline air pressure as an average of the air pressure samples.

12. The method of claim 8, further comprising, while phase two is active, the steps of:

estimating a phase two recirculated exhaust gas volume; and referencing the phase two threshold value as a predetermined function of the estimated phase two recirculated exhaust gas volume.

* * * * *